US005285912A

United States Patent [19]

Molinaro

[11] Patent Number: 5,285,912

[45] Date of Patent: Feb. 15, 1994

[54] SNAP ON PULL OFF TAMPER INDICATING FLEXIBLE CAP AND NECK CONFIGURATION

[75] Inventor: Luca Molinaro, New Castle, Pa.

[73] Assignee: Northern Engineering & Plastics, Corp., New Castle, Pa.

[21] Appl. No.: 89,769

[22] Filed: Jul. 9, 1993

Related U.S. Application Data

[63] Continuation-in-part of Ser. No. 922,241, Jul. 31, 1992.

[51] Int. Cl.[5] ..... B65D 1/02

[52] U.S. Cl. ..... 215/256; 215/318

[58] Field of Search ..... 215/256, 318, 329, 254, 215/252; 220/296

[56] References Cited

U.S. PATENT DOCUMENTS

| | | | |
|---|---|---|---|
| 1,443,682 | 1/1923 | Gueritey . | |
| 2,063,538 | 12/1936 | Dahl | 220/296 |
| 2,162,711 | 6/1939 | Hamberger . | |
| 2,162,712 | 6/1939 | Hamberger . | |
| 3,504,818 | 4/1970 | Crisci et al. . | |
| 3,650,428 | 3/1972 | Miller . | |
| 3,980,195 | 9/1976 | Fillmore . | |
| 4,298,129 | 11/1981 | Stull | 215/328 |
| 4,402,415 | 9/1983 | Hopley . | |
| 4,418,828 | 12/1983 | Wilde et al. . | |
| 4,497,765 | 2/1985 | Wilde et al. . | |
| 4,534,480 | 8/1985 | Santostasi et al. . | |
| 4,561,553 | 12/1985 | Crisci . | |
| 4,852,774 | 8/1989 | Crawford . | |
| 5,004,114 | 4/1991 | Terbrusch et al. . | |

*Primary Examiner*—Joseph Man-Fu Moy
*Attorney, Agent, or Firm*—Harpman & Harpman

[57] ABSTRACT

A novel snap on pull off tamper indicating cap and neck configuration for containers, the cap having a top with an annular depending wall on its peripheral edge and seven circumferentially spaced continuous spiral thread configurations on the inner surface of the annular depending wall. A removable tear skirt with continuous ratchet teeth on its inner surface depends from the outer peripheral edge of an outturned flange on said annular wall. An annular rib on said ratchet teeth, the tear skirt is joined to the flange with only the points of the ratchet teeth, a pull tab on the tear skirt with frangible lines enabling removing of the tab and tear skirt from the cap. Ratchet teeth on the container have a continuous longitudinally extending notch within for interlocking registration with the annular rib on the ratchet teeth of the tear skirt.

4 Claims, 2 Drawing Sheets

SNAP ON PULL OFF TAMPER INDICATING FLEXIBLE CAP AND NECK CONFIGURATION

This in a continuation-in-part of Ser. No. 07/922,241 filed July 31, 1992.

BACKGROUND OF THE INVENTION

1. Technical Field:

This invention relates to tamper-indicating caps and registering conforming container neck finishes on blow molded plastic jugs which are widely used in the dairy industry and others for expendible packaging of dairy products and the like.

2. Description of the Prior Art:

Prior art devices of this type have relied on a variety of different cap and neck finish configurations. See for example a first group of U.S. Pat. Nos. 3,980,195, 4,354,609, 4,402,415, 4,561,553, and a second group of U.S. Pat. Nos. 2,162,711, 2,162,712, 3,650,428, 4,418,828, 4,497,765, 4,534,480, 3,504,818 and a third group of configurations, U.S. Pat. Nos. 1,443,682, 4,852,774 and 5,004,114.

In the first and second group of the above-referred to U.S. Patents, they are directed towards individual neck and cap spiral thread configuration and have the common fault of requiring selective testing rotation of the cap on the threaded neck of the container before the single thread portions engage.

The patents included in the third group are directed to selective multiple thread configurations with specific reference now to U.S. Pat. No. 1,443,682, a thread pattern is disclosed having non-overlapping thread elements.

U.S. Pat No. 4,852,774 is directed towards a container cap having a plurality of short arcuate inner threads adjacent the outer end of the cap.

U.S. Pat. No. 5,004,114 shows only the container with a neck finish having a plurality of inter-engaging twist threads.

SUMMARY OF THE INVENTION

A push on pull off tamper-indicating flexible cap for containers such as blow molded jugs with the appropriate neck configuration takes the form of a cap portion having a top and an annular depending wall on its peripheral edge radially spaced from an annular sealing flange depending from the top of the cap. There are multiple continuous thread patterns on the inner surface of the annular depending wall and an outturned flange on the lower edge of the annular depending wall has a plurality of circumferentially spaced openings therein integral to connections from the wall to continuous ratchet teeth configurations above and below a continuous inturned flange on the inner surface of a tear skirt secured to the outturned on the annular wall to form a circumferential frangible line.

The neck configuration has spaced areas of continuous ratchet teeth configurations having a continuous annular groove spaced within for registration with the continuous inturned flange on the inner surface of the tear of the tear skirt. A pull tab attached to the tear skirt adjacent a vertically positioned weakened line enables the tear skirt with its continuous rachet teeth configurations and inturned flange to be removed.

DESCRIPTION OF THE PREFERRED EMBODIMENT

A portion of a container 10 can be seen having a neck 11 on which one of a pair of oppositely disposed vertically arranged fastening configurations comprising ratchet teeth 12 is illustrated. A plurality of horizontally and vertically spaced continuous annular spiral threads 13, 14 and 15 are positioned above the ratchet teeth 12.

Figure 1:
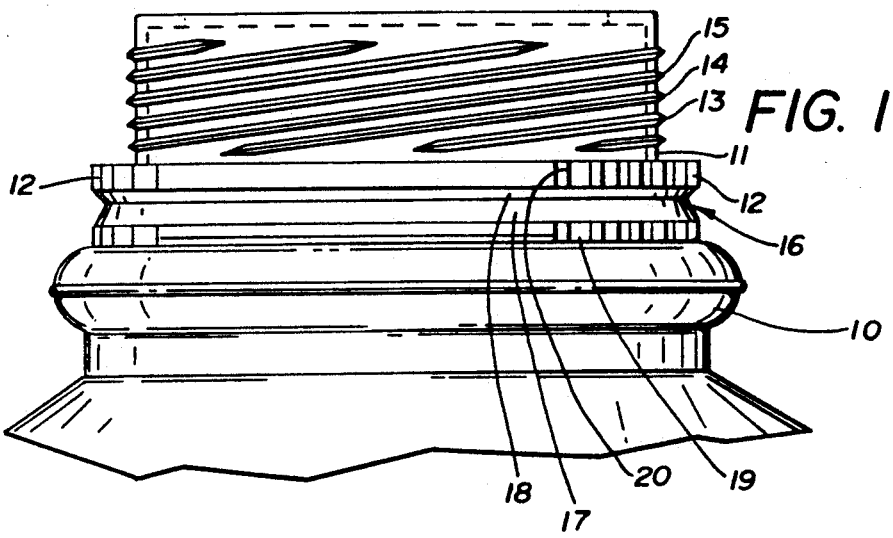
FIG. 1 is a side elevation of the finish on the neck of a blow molded jug.
Figure 2:
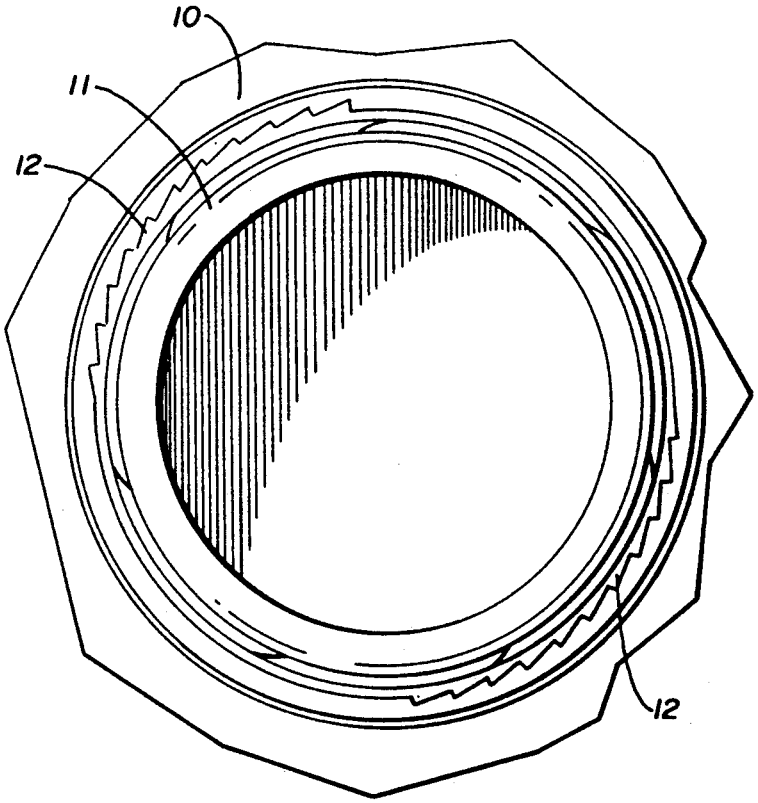
FIG. 2 is a top plan view of the neck finish shown in FIG. 1.

Referring to FIG. 1 of the drawings, each of the ratchet teeth configurations 12 have a continuous horizontally disposed elongated groove 16 positioned midway along their vertical surface, extending annularly around the neck 11. The groove 16 is characterized by unequal angular surfaces 17 and 18 extending inwardly from respective ratchet portions 19 and 20 defined by the intersection of the groove 16 in the ratchet teeth configurations Still referring to FIG. 1 of the drawings, it will be seen that each of the vertical and horizontally spaced annular spiral threads 13, 14 and 15 extend continuously for more than a complete spiral circle before terminating on the cylindrical neck portion 11 in spaced relation to an upper surface 21 of the neck 11.

Figure 3:
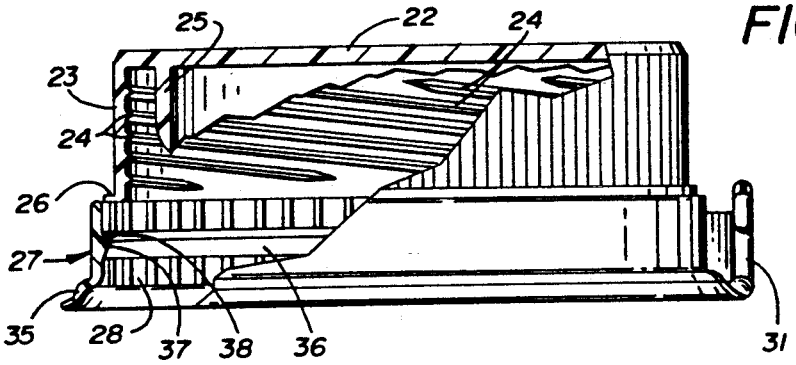
FIG. 3 is a side elevation of the push on pull off cap with parts broken away.
Figure 4:
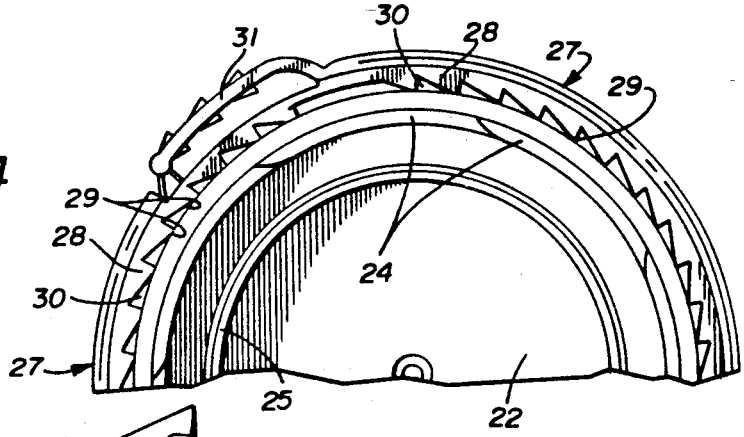
FIG. 4 is a bottom view of a portion of a push on pull off flexible cap illustrating the novel continuous rachet teeth configuration on the tear skirt and its limited attachment to the remainder of the cap.
Figure 5:
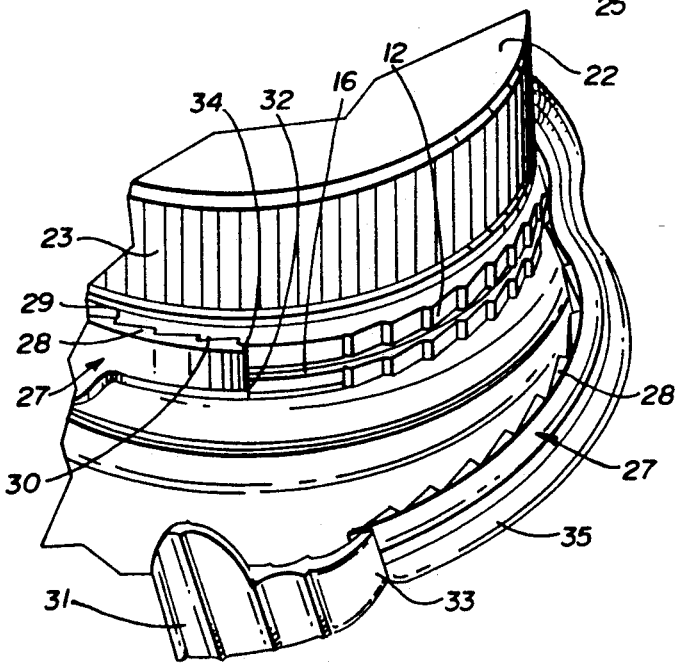
FIG. 5 is a perspective elevation of the flexible push on pull off cap with parts broken away in position on a neck finish of a portion of a blow molded jug.

Referring to FIGS. 3, 4 and 5 of the drawings, an improved push on, pull off tamper indicating flexible cap can be seen having a top 22, an annular depending wall 23 with spiral configured flanges 23 on its inner surface for corresponding registration with the hereinbefore described spiral threads 13 through 15 on the neck 11. The annular wall 23 is integrally joined to the peripheral edge of the top 22. The cap is provided with a downturned annular sealing flange 25 depending from the bottom of the top 22 inwardly of said depending annular wall 23. An outturned flange 26 extends from the bottom peripheral edge of the annular wall 23 defining a transition area between the annular wall 23 and a tear skirt 27. The tear skirt 27 is of a larger diameter than that of the flange 26 and is formed with its inner surface having a continuous rachet configuration 28. Each of the ratchet teeth 28 has a connecting member 29 extending therefrom by which the tear skirt 27 is integrally attached to the lower peripheral edge of the outturned flange 26.

It will be seen that the connecting members 29 extend from and are formed by an upper edge portion of each of said ratchet teeth 28 adjacent the flange 26 by which the tear skirt 27 integrally attaches to the lower peripheral edge of the flange 26 as hereinbefore described.

It will be seen that the connecting members 29 are spaced circumferentially with the corresponding ratchet teeth 28 so as to leave a plurality of corresponding openings at 30 therebetween as seen in FIG. 4 of the drawings.

Referring now to FIG. 5 of the drawings, the push on, pull off tamper indicating flexible cap can be seen on the neck 11 of the container. The tear skirt 27 is illustrated partially separated from the flange 26 of the annular depending wall 23 of the cap wherein the continuous ratchet teeth 28 are separated for their engagement with the lower peripheral edge of the outturned annular flange 26 which defines the lower edge of the annular depending wall 23.

The continuous ratchet teeth 28 of the flexible tear skirt 27 is shown partially disengaged from one of the two groups of the ratchet teeth 12 on the neck 11 of the container 10. In order that the continuous ratchet strip comprising the tear skirt 27 be free from the remainder of the cap as shown in FIG. 5, a tear tab 31 is freed from a vertical tear line 32 and moved outwardly as illustrated. It will occur to those skilled in the art that by removing the tear skirt 27 completely, it is necessary to break away each of the connecting members 29 which are formed by the upper edge portion of each of the ratchet teeth 28 which are closely circumferentially spaced with respect to one another and provide a very durable connection which is not subject to accidental tearing during the handling of the cap as in installing the same on the neck 11 of the container 20.

By referring again to FIGS. 1 and 3 of the drawings, it will be seen that the tear skirt 27 which comprises the elongated ratchet strip with the ratchet teeth 28 joined at one of its ends 33 to the tear tab 31 and its other end at 34 terminates in the vertical tear line 32. The tear skirt 27 as formed and in use position as best seen in FIG. 3 of the drawings is positioned vertically and it will also be seen that its lower edge is provided with an outturned flange 35 which will engage and rest on the portion of the container 10 immediately below the neck portion 11. The tear skirt 27 has a continuous annular extending locking flange 36 formed intermittently within the elongated ratchet teeth 28 aligned for registration within the groove 16 in the ratchet teeth configurations 12 and the neck 11 therebetween, the locking flange 36 provides for a positive snap on-tear off retaining element to prevent removable of the cap from the container neck once the snap on has occurred. The locking flange 36 has unequal angular surfaces 37 and 38 that correspond to the groove's (16) respective angular surfaces 17 and 18 as best seen in FIGS. 1-5 of the drawings.

It will thus be seen that the push on or screw on, pull off tamper indicating flexible cap for containers or the like is disclosed herein has several points of novelty by reason of the continuous elongated groove 16 with its unequal angular surfaces 17 and 18 formed within the neck of the container 10 and the corresponding engageable locking flange's (36) annular surfaces 37 and 38 positioned intermittently within the ratchet 28 within the tear skirt 27 of the cap and the attachment of the tear skirt 27 to the lower surface of the outturned narrow flange 26 by multiple connectors 29 formed by the actual intersection of the ratchet teeth 28 therewith. This results in an unusual and novel cap retaining structure with the advantages of a locking rib retainer in a one-way inter-engaging ratchet configuration.

It will thus be seen that a substantially changed and improved neck finish on a container or the like and a flexible push on, pull off or twist on, twist off cap has been illustrated and described and having thus described my invention, what I claim is:

1. A push on, pull off tamper indicating flexible cap and neck configuration for containers having a neck surrounding an opening therein comprising: a plurality of circumferentially and vertically spaced spiral thread configurations on said neck having lead-in points to form multiple means for registering engagement with said flexible cap having registrable spiral thread configurations thereon, a pair of vertically arranged fastening configurations on the exterior of said neck, a continuous groove within said fastening configurations defining vertically spaced identical ratchet portions, said cap comprising a top portion, an annular depending wall on the peripheral edge of said top portion, an outturned annular flange extending from the bottom peripheral edge of said annular depending wall, a tear skirt having continuous vertical ratchet teeth with connecting members formed thereby joined to said annular outturned flange to support the tear skirt, an inturned locking flange intermediately within the continuous vertical ratchet teeth, a frangible line in said tear skirt and a pull tab secured to said tear skirt at one side of said frangible line, said inturned locking flange within the continuous vertical ratchet teeth on the inner surface of the tear skirt arranged to engage within said continuous groove in said fastening configuration, said continuous vertical ratchet teeth arranged to engage said vertically fastening configurations on the neck of the container to prevent rotation of the cap until the tear skirt is removed.

2. The push on, pull off tamper indicating flexible cap and neck configuration of claim 1 wherein the continuous groove within said fastening configurations have unequal angular surfaces extending inwardly from said respective identical ratchet portions therebetween.

3. The push on, pull off tamper indicating flexible cap and neck configuration of claim 1 wherein said inturned locking flange within said continuous vertical ratchet teeth on the inner surface of said tear skirt has unequal angular surfaces for selective locking registration within said continuous groove within said fastening configurations.

4. The push on, pull off tamper indicating flexible cap and neck configuration of claim 1 wherein said outturned annular flange extending from the bottom peripheral edge of said annular depending wall is joined to said tear skirt by upper edge portions of said respective continuous vertical ratchet teeth so as to define circumferentially spaced integral connections therebetween.

* * * * *